US008972158B2

(12) United States Patent
Miyazawa

(10) Patent No.: US 8,972,158 B2
(45) Date of Patent: Mar. 3, 2015

(54) SEMICONDUCTOR DEVICE PROVIDING A CURRENT CONTROL FUNCTION AND A SELF SHUT DOWN FUNCTION

(75) Inventor: Shigemi Miyazawa, Nagano (JP)

(73) Assignee: Fuji Electric Co., Ltd. (JP)

( * ) Notice: Subject to any disclaimer, the term of this patent is extended or adjusted under 35 U.S.C. 154(b) by 636 days.

(21) Appl. No.: 13/371,692

(22) Filed: Feb. 13, 2012

(65) Prior Publication Data

US 2012/0215431 A1 Aug. 23, 2012

(30) Foreign Application Priority Data

Feb. 21, 2011 (JP) ..... 2011-034463

(51) Int. Cl.
*F02P 3/05* (2006.01)
*F02P 3/055* (2006.01)

(52) U.S. Cl.
CPC ..... *F02P 3/0552* (2013.01)
USPC ..... 701/115; 123/623; 123/624; 123/644

(58) Field of Classification Search
CPC ..... F02P 3/05; F02P 3/055; F02P 3/0552; F02P 3/0554
USPC ..... 701/115; 123/623, 624, 630, 644
See application file for complete search history.

(56) References Cited

U.S. PATENT DOCUMENTS

| | | | | |
|---|---|---|---|---|
| 7,541,858 | B2 | 6/2009 | Yukutake et al. | |
| 8,836,042 | B2 * | 9/2014 | Ueno | 257/370 |
| 2005/0061306 | A1 * | 3/2005 | Naruse et al. | 123/618 |
| 2005/0252496 | A1 * | 11/2005 | Ando et al. | 123/644 |
| 2013/0241609 | A1 * | 9/2013 | Miyazawa | 327/142 |
| 2013/0279067 | A1 * | 10/2013 | Yamada | 361/253 |

FOREIGN PATENT DOCUMENTS

| | | | |
|---|---|---|---|
| JP | 2006-037822 | A | 2/2006 |
| JP | 2008-045514 | A | 2/2008 |
| JP | 2010-178317 | A | 8/2010 |

* cited by examiner

*Primary Examiner* — Erick Solis
(74) *Attorney, Agent, or Firm* — Rossi, Kimms & McDowell LLP

(57) ABSTRACT

Aspects of the invention are directed to an ignition semiconductor device that includes an output IGBT for ON-OFF control of a primary current in an ignition coil and a current control circuit for controlling a magnitude of the primary current in the ignition coil, the current control circuit being operated by the voltage between the gate terminal and the emitter terminal. The current control circuit can include a sense IGBT, a sense resistance, a gate resistance, a reference voltage, level shift circuits, a self shut down signal generator, a self shut down circuit, an operational amplifier, a MOSFET, a gate voltage control circuit , a pulse generation circuit, and a switching circuit. The self shut down signal generator, on detecting an abnormal state, can deliver a self shut down signal and the pulse generation circuit can generate a pulse signal to short-circuit the switching circuit.

9 Claims, 9 Drawing Sheets

SEMICONDUCTOR DEVICE PROVIDING A CURRENT CONTROL FUNCTION AND A SELF SHUT DOWN FUNCTION

BACKGROUND OF THE INVENTION

1. Field of the Invention

Embodiments of the invention are directed to semiconductor devices, and, in particular, semiconductor devices providing current control and self shut down functions.

2. Description of the Related Art

Ignition devices for internal combustion engines of vehicles use a semiconductor device installing a power semiconductor element to control switching of the primary side current in the ignition coil. FIG. 2 shows a conventional construction example of an ignition semiconductor device for an internal combustion engine of a vehicle using an insulated gate bipolar transistor (in the following, an IGBT) as the power semiconductor element. The construction example of ignition device shown in FIG. 2 is similar to that of Applicants' Japanese Patent Application No. 2010-178317.

The ignition semiconductor device of FIG. 2 comprises an electronic control unit (ECU) 1 for engine control, an ignition semiconductor integrated circuit (an ignition IC) 2, an ignition coil 7, a voltage source 10, and an ignition plug 11.

The ignition IC 2 comprises an output IGBT 4 for ON/OFF (short circuiting or opening) controlling the primary current in the ignition coil and a current control circuit 3 for controlling the collector current in the output IGBT 4, which is the primary side current in the ignition coil 7.

The voltage source 10 supplies a constant voltage for example 14 V to one terminal of the primary winding 8 of the ignition coil 7 connected to the voltage source 10. The other terminal of the primary winding 8 is connected to the C terminal, which is a collector electrode terminal, of the ignition IC 2. The E terminal, which is an emitter electrode terminal, of the ignition IC 2 is connected to the ground potential terminal (GND) and the G terminal, which is a gate electrode terminal, is connected to the ECU 1.

Now, operation of the ignition semiconductor device shown in FIG. 2 will be described in the following. The ECU 1 delivers a signal for ON/OFF controlling the output IGBT 4 of the ignition IC 2 to the G terminal of the ignition IC 2. When a voltage of 5 V, for example, is delivered to the G terminal, the output IGBT 4 of the ignition IC 2 turns ON; and when a voltage of zero volts is delivered to the G terminal, the output IGBT 4 of the ignition IC 2 turns OFF.

Upon delivery of an ON signal from the ECU 1 to the G terminal, the output IGBT 4 of the ignition IC 2 turns ON and a collector current Ic starts to flow from the voltage source 10 through the primary winding 8 of the ignition coil 7 to the C terminal of the ignition IC 2. The current variation rate dI/dt of the current Ic is determined by the inductance value of the primary winding 8 and the voltage applied to the primary winding 8. When the current Ic reaches a certain value, for example 20 A, which is controlled by the current control circuit 3, the current Ic is held at this constant value.

Upon delivery of an OFF signal from the ECU 1 to the G terminal, the output IGBT 4 of the ignition IC 2 turns OFF and the current Ic abruptly decreases. This abrupt change in the current Ic causes rapid increase in the voltage between the terminals of the primary winding 8, which in turn raises the voltage between the terminals of the secondary winding 9 up to several tens of kilovolts for example 30 kV. This high voltage is added to the ignition plug 11. The ignition plug 11 is designed to discharge at applied voltages high than about 10 kV.

If the ON signal is delivered from the ECU 1 for a time duration longer than a predetermined time for example longer than 10 msec, or the temperature of the ignition IC 2 is higher than the prescribed value for example 180° C., the ignition device is in an abnormal condition that may cause damage such as burning of the ignition coil 7 or ignition IC 2. In such abnormal conditions, the self shut down signal generator 15 generates a self shunt down signal Vsd by means of a timer circuit and a temperature detection circuit and drives operation of the self shut down circuit 16 to interrupt the current Ic.

The rapid shut down of the current Ic utilizing the current control function and the self shunt down function generates oscillation in the current Ic, which would cause erroneous ignition of the ignition plug and damages in the engine. In order to cope with the problem of erroneous ignition due to the oscillation of the current Ic, Japanese Unexamined Patent Application Publication No. 2008-045514 discloses a technique to slowly decrease the current Ic by providing a soft shut off circuit and setting a slow damping time. Besides, Japanese Unexamined Patent Application Publication No. 2006-037822 discloses a technique to set a slow damping time by providing an integration circuit composed of a diode and a capacitor.

The ignition semiconductor device shown in FIG. 2 controls the output IGBT 4 of the ignition IC 2 by a gate voltage control circuit 19, which will be described later, and executes slow damping of the current Ic at a rate dI/dt of, for example, about −1 A/msec, in such a range that avoids erroneous ignition of the ignition plug 11.

The following describes the circuit construction of the current control circuit 3 of the ignition IC 2 shown in FIG. 2. The current control circuit 3 is driven by the voltage between the G terminal and the E terminal, and comprises a sense IGBT 5, a sense resistance 6, a gate resistance 12, a reference voltage circuit 13, level shift circuits 14*a* and 14*b*, a self shut down signal generator 15, a self shut down circuit 16, an operational amplifier 17, a metal oxide semiconductor field effect transistor (simply referred to as a MOS in the following) 18, and a gate voltage control circuit 19.

The sense IGBT 5 has a collector connected in common to the collector of the output IGBT 4, a gate controlled by the gate voltage control circuit 19, and an emitter connected in series to the sense resistance 6. The sense IGBT 5 and the sense resistance 6 comprise the sense voltage detection circuit, and convert the sense current flowing in the sense resistance 6 to a voltage and generate a source sense voltage Vs that is the voltage obtained by converting the current value proportional to the current Ic. The operational amplifier 17 controls the gate voltage of the MOS 18 so as to equalize the source sense voltage Vs to a voltage value that is preliminarily set in the reference voltage circuit 13, and thereby control the gate voltages of the output IGBT 4 and the sense IGBT 5 through the gate resistance 12 and the gate voltage control circuit 19 to control the current Ic to a specified current value.

FIG. 3 shows an example of circuit construction of the reference voltage circuit 13, which is composed of a bias circuit and a voltage dividing circuit. The bias circuit comprises a DepMOS (a depletion metal oxide semiconductor field effect transistor) 22 and a MOS 23 series connected with a common gate terminal. The voltage dividing circuit comprises a resistance 24 and a resistance 25. The reference voltage circuit 13 with this construction generates a source reference voltage Vr by dividing the voltage obtained by the bias circuit and the voltage dividing circuit in a predetermined ratio. The set voltage of this source reference voltage Vr is used for controlling the rated current of the current Ic.

FIG. 4 shows an example of circuit construction of the level shift circuits 14*a* and 14*b*. The level shift circuits 14*a* and 14*b* have the same construction as shown in FIG. 4. Each of the level shift circuit 14*a* and 14*b* is composed of a bias circuit comprising DepMOS 26 and MOS 27 connected in series with a common gate electrode, MOS 29 composing a current Miller circuit with the MOS 27, and DepMOS 28 connected to the MOS 29 in series. The level shift circuit 14*a* or 14*b* receives an input signal, the sense reference voltage Vr or the source sense voltage Vs, controlling the gate voltage of the DepMOS 28 and generates and delivers an output signal, a reference voltage Vref or a sense voltage Vsns that is level-shifted to a predetermined voltage value.

FIG. 5 shows an example of construction of the self shut down circuit 16. The self shunt down circuit 16 is composed of a bias circuit comprising a DepMOS 30 and a MOS 31 connected in series with a common gate electrode, a MOS 34 composing a current Miller circuit with the MOS 31, a MOS 33 series-connected to the MOS 34, an inverter 32, and a capacitor 35. The MOS 33 is ON-OFF controlled by the self shunt down signal Vsd generated by the self shut down signal generator 15, and in the ON state in the normal operation condition and in the OFF state in the abnormal condition. The ON resistance of the MOS 33 is set at a value sufficiently smaller than the ON resistance of the MOS 34. In this setting, the reference voltage Vref, which is obtained by level-shifting the source reference voltage Vr, is charged on the capacitor 35 during normal operation and delivered from the output terminal. In the abnormal condition, the reference voltage Vref charged in the capacitor 35 is discharged to the GND through the MOS 34, gradually decreasing the output voltage from Vref to zero volts.

The operational amplifier 17 detects a difference voltage between the reference voltage Vref and the sense voltage Vsns, the two voltages being level-shifted through the level shift circuit 14*a* and the level shift circuit 14*b*, respectively. The gate voltage of the MOS 18 is controlled according to the detection results. If the reference voltage Vref is greater than the sense voltage Vsns, the MOS 18 becomes the OFF state; If the reference voltage Vref is smaller than the sense voltage Vsns, the MOS 18 becomes the ON state. Thus, the gate voltage controls the ON resistance of the MOS 18.

The gate voltage control circuit 19 shown in FIG. 6 has a circuit construction described in Applicants' Japanese Patent Application No. 2010-178317, applied by the applicant of the present application. The gate voltage control circuit 19 is operated by the voltage that is determined by the gate resistance 12 connected to the G terminal and the ON-OFF state of the MOS 18 with respect to the potential at the E terminal. The gate voltage VGout of the output IGBT 4 is controlled by the voltage divided by a shunt resistance circuit consisting of a resistance 41 and a resistance 42. The gate voltage control circuit 19 comprises a variable resistance circuit composed of a resistance 38, a resistance 39, and a MOS 40. The MOS 40 is driven by a gate voltage that is a voltage divided by a shunt resistance circuit consisting of a resistance 36 and a resistance 37. Thus, the ON resistance of the MOS 40 is controlled to vary the gate voltage VGsns of the sense IGBT 5, which is a divided voltage from the variable resistance circuit.

The gate voltage control circuit 19 receives the detection result of the difference voltage between the reference voltage Vref and the sense voltage Vsns, and provides a voltage difference (an offset voltage) between the gate voltage VGout for the output IGBT 4 and the gate voltage VGsns for the sense IGBT 5. Thus, the gate voltage control circuit 19 functions to suppress collector current oscillation in the processes of current control and self shut down and prevent the ignition plug from erroneous ignition.

The following describes operation of the ignition semiconductor device shown in FIG. 2 with reference to FIGS. 9(A) and 9(B). FIG. 9(A) shows a case in which self shut down is conducted after the current Ic has reached the limiting current Ilim. When an ON signal for example at 5 V is delivered from the ECU 1, the sense voltage Vsns increases, the sense voltage Vsns being a voltage elevated from the source sense voltage Vs in the level shift circuit 14*b*. When the sense voltage Vsns reaches the reference voltage Vref at the time t1, the reference voltage Vref being a voltage elevated from the source sense voltage Vr of the reference voltage circuit 13 in the level shift circuit 14*a*, the MOS 18 turns ON and the gate voltage VGout of the output IGBT 4 drops to a certain lower value while the relation Vref=Vsns is held under control of the operational amplifier 17. When a self shut down signal Vsd is delivered from the self shut down signal generator 15 at the time t2, the reference voltage Vref through the self shut down circuit 16 gradually decreases and the VGout decreases so as to maintain the relation Vref=Vsns. When the VGout decreases to the threshold voltage Vth of the IGBT 4 for example 2 V at the time t3, the current Ic is completely shut down.

Although the sense voltage Vsns does not decrease lower than the voltage, for example 0.5 V, determined by the level shift circuit 14*b*, the reference voltage Vref continues to decrease down to approximately zero volts. As a result, the VGout becomes sufficiently smaller than the Vth to shut down the current Ic completely. The level shift circuits 14*a* and 14*b* are provided so as to hold the relation Vsns>Vref>0 even in the state of Ic=0.

Normal operation conditions are assumed in the ignition semiconductor device shown in FIG. 2 in which the set current control value Ilim=20 A, driving voltage Vb of the voltage source 10 Vb=14 V, and the load resistance RL of the sum of the resistance of the primary winding 8 and the wiring resistance RL=0.6Ω. A situation changed from these normal operation conditions is considered in which the driving voltage Vb has decreased to 12 V, for example, or the load resistance RL has increased to 0.7Ω, for example. Operation in this situation is illustrated in FIG. 9(B). When an ON signal for example at 5 V is delivered from the ECU 1 at the time t4, the sense voltage Vsns increases but not reaches the reference voltage Vref and ceases to increase at a certain voltage and remains at that voltage. In this time, the current Ic=(Vb−Vc)/RL, where Vc is a collector voltage. When a self shut down signal Vsd is delivered from the self shut down signal generator 15 at the time t5, the reference voltage Vref through the self shut down circuit 16 begins to gradually decrease. Immediately after the condition Vref=Vsns is reached at the time t6, the VGout abruptly drops to a certain lower value and then gradually decreases so as to hold the relation Vref=Vsns.

In the case the self shut down operation is conducted by means of a timer circuit provided in the self shut down signal generator 15, even if a self shut down signal Vsd is delivered correctly from the timer circuit, a delay time t6−t5 arises and elapses until start of decrease in the current Ic. Thus, a virtual timer period changes depending on operation conditions including the driving voltage Vb and the load resistance RL.

FIG. 8A shows dependence of the delay time on the driving voltage Vb and FIG. 8B shows dependence of the delay time on the load resistance RL under the conditions a diffusion potential Vbi of the output IGBT 4 Vbi=0.6 V, an ON resistance Ron=0.07Ω, and a damping speed dI/dt=−1 A/msec. An ignition semiconductor device needs to deal with wide range of operation conditions taking wide variety of applications into consideration, and the delay time t6−t5 is thus desired invariant in the self shut down operation. Nevertheless, the delay time may be elongated to twice the predetermined timer period of 10 msec, for example, under some operation conditions. In the case the self shut down operation is triggered by temperature rise due to self heating, a self shut down signal Vsd is formed by a temperature detection circuit in the self shut down signal generator 15 and delivered from the self shut down signal generator 15. However, a delay time t6−t5 elapses from delivery of the self shut down signal Vsd until the current Ic starts to decrease. During the delay time, the operation temperature continues to increase. Therefore, an operation mode is desired in which the current Ic decreases immediately after delivery of the self shut down signal Vsd.

SUMMARY OF THE INVENTION

Embodiments of the invention address these and other needs. Embodiments of the invention provide an ignition semiconductor device performing a current control function and a self shut down function that performs self shut down in a predetermined definite time irrespective of variation in the driving voltage Vb or the load resistance RL, as well as to provide a means for slow damping of the current Ic in execution of the current control function or the self shut down function.

Embodiments of the invention provide an a current control function and a self shut down function according to the present invention comprises a pulse generation circuit and a switching circuit wherein the switching circuit is short-circuited during for a short period of time immediately after delivery of a self shut down signal Vsd and opened at the time the condition of the reference voltage Vref=the sense voltage Vsns is established.

Embodiments of the invention are directed to a semiconductor device providing a current control function and a self shut down function according to the present invention comprises: an insulated gate bipolar transistor for controlling ON-OFF of a primary current in a primary winding of an ignition coil responding to an ignition signal and a current control circuit for controlling a magnitude of the primary current, the current control circuit comprising: a self shut down circuit for shutting down the primary current on detection of one of abnormal states including an overcurrent state in which the primary current exceeds a predetermined rated current; wherein the semiconductor device set the rated current to be equal to the primary current on detection of the abnormal states by the self shut down circuit.

In a semiconductor device providing a current control function and a self shut down function according to embodiments of the invention, the self shut down circuit can generate a reference voltage at one terminal of a capacitor provided in the self shut down circuit, the reference voltage being obtained by converting the rated current to the reference voltage, and the semiconductor device detects a sense voltage that is obtained by converting the primary current to the sense voltage and controls the primary current so that the sense voltage equals the reference voltage, and the voltage at the one terminal of the capacitor can be equalized to the sense voltage on detection of the abnormal state by the self shut down circuit.

In a semiconductor device providing a current control function and a self shut down function according embodiments of the invention, after equalizing the sense voltage and the voltage at the one terminal of the capacitor, the capacitor is separated from a terminal that is at the sense voltage and discharged by a bias circuit of the self shut down circuit.

A semiconductor device providing a current control function and a self shut down function in another aspect of the invention can include an insulated gate bipolar transistor for controlling ON-OFF of a primary current in a primary winding of an ignition coil responding to an ignition signal and a current control circuit for controlling a magnitude of the primary current, the current control circuit including a sense voltage detection circuit for detecting a sense voltage that is a voltage obtained by converting the primary current, a reference voltage circuit for generating a reference voltage that is a voltage obtained by converting a predetermined rated current, a gate voltage control circuit for detecting a voltage difference between the sense voltage and the reference voltage and for controlling a gate voltage of the insulated gate bipolar transistor so as to equalize the primary current to the rated current. The embodiment can also include a self shut down circuit for shutting down the primary current on detection, by the self shut down circuit, of one of abnormal states including an overcurrent state in which the primary current exceeds the rated current; a pulse generation circuit for generating a pulse signal for a short period of time on detection of the one of abnormal states by the self shut down circuit and a switching circuit for executing ON-OFF operation thereof controlled by the pulse signal, wherein the switching circuit is made in a conductive state for a short period of time by the pulse signal on occurrence of the one of abnormal states to set the reference voltage to become equal to the sense voltage.

In embodiments of the semiconductor device providing a current control function and a self shut down function as described above, the switching circuit can include a MOSFET.

In embodiments of the semiconductor device providing a current control function and a self shut down function as described above, the pulse generation circuit can include an integration circuit and an inverter that receive a self shut down signal informing detection of the one of abnormal states by the self shut down circuit at an terminal of the integration circuit and at a driving voltage terminal of the inverter, and an output from the integration circuit is delivered to the inverter to generate a pulse signal for a short period of time.

Ignition semiconductor devices providing a current control function and a self shut down function according to embodiments of the invention can include a pulse generation circuit and a switching circuit wherein the switching circuit is short-circuited for a short period of time immediately after delivery of a self shut down signal Vsd and opened at the time the condition of the reference voltage Vref=the sense voltage Vsns is established. Therefore, an ignition semiconductor device has been provided that performs self shut down operation in a predetermined definite time irrespective of variation in the driving voltage Vb or the load resistance RL. The ignition semiconductor device of certain embodiments also avoids erroneous ignition of the ignition coil in execution of the current control function and the self shut down function.

DETAILED DESCRIPTION

A semiconductor device providing a current control function and a self shut down function of an embodiment according to the present invention is described in the following with reference to the accompanying drawings.

Figure 1:
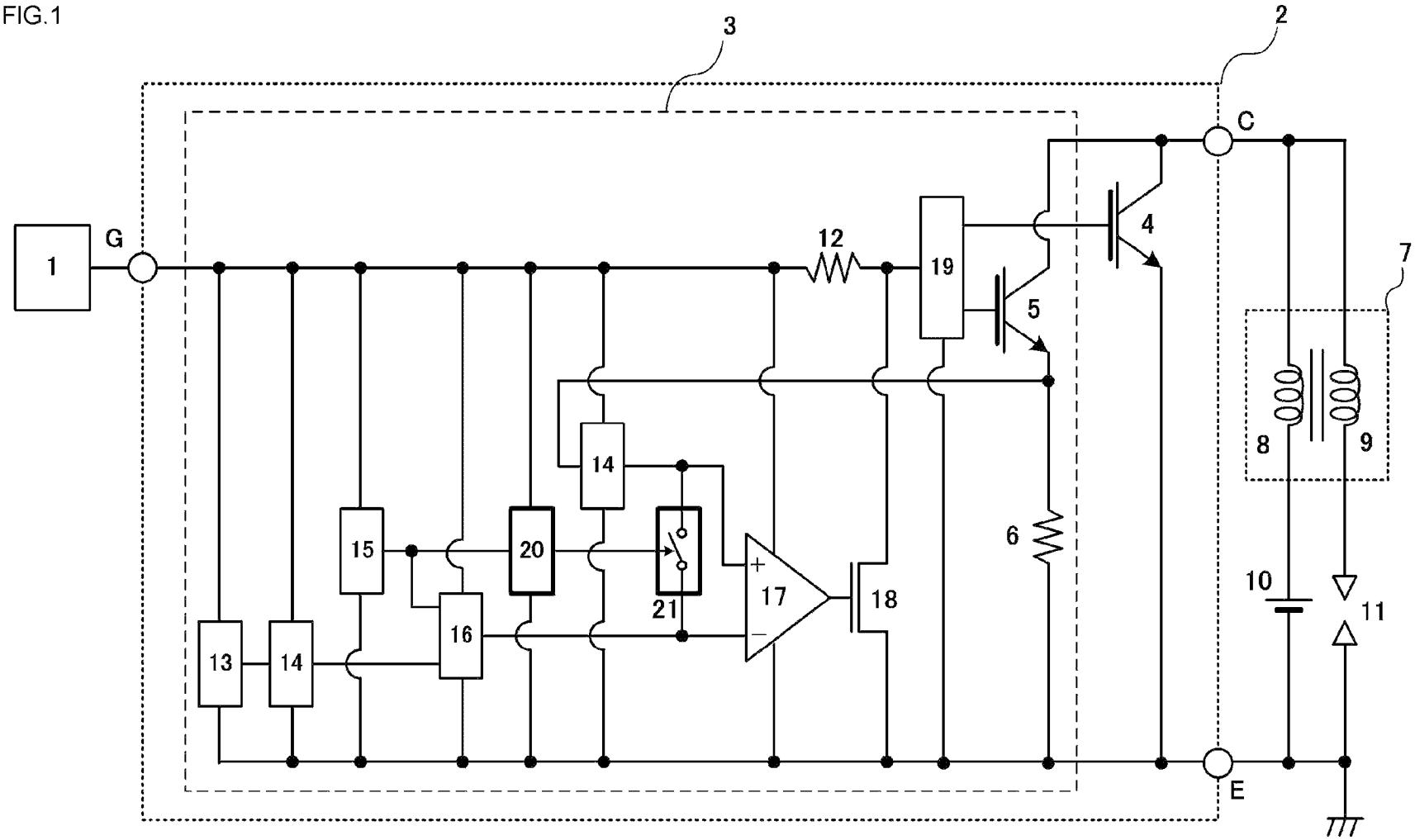
FIG. 1 shows an example of a semiconductor device providing a current control function and a self shut down function according to an embodiment of the present invention.
Figure 2:
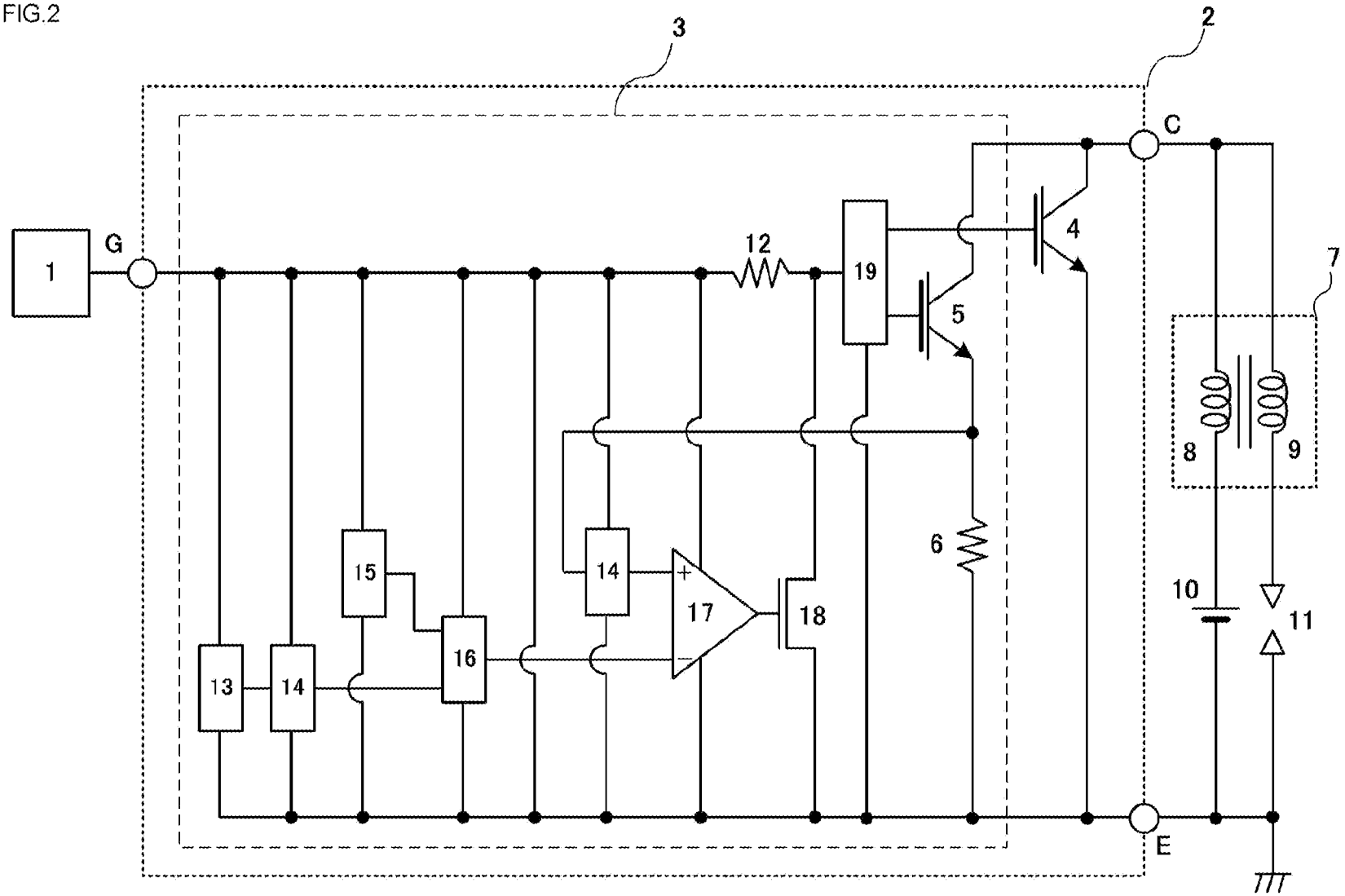
FIG. 2 shows an example of construction of a conventional semiconductor device providing a current control function and a self shut down function.
Figure 3:
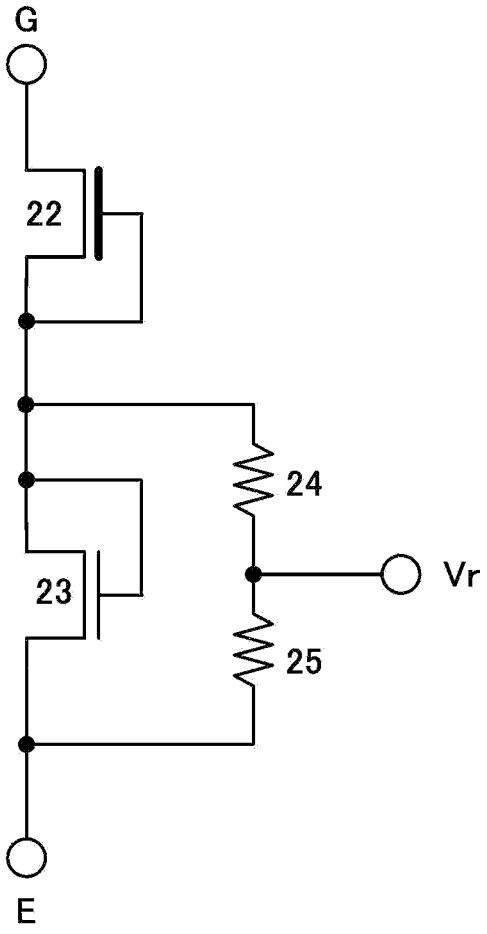
FIG. 3 shows an example of circuit construction of a reference voltage circuit 13 in the semiconductor device according to embodiments of the present invention.
Figure 4:
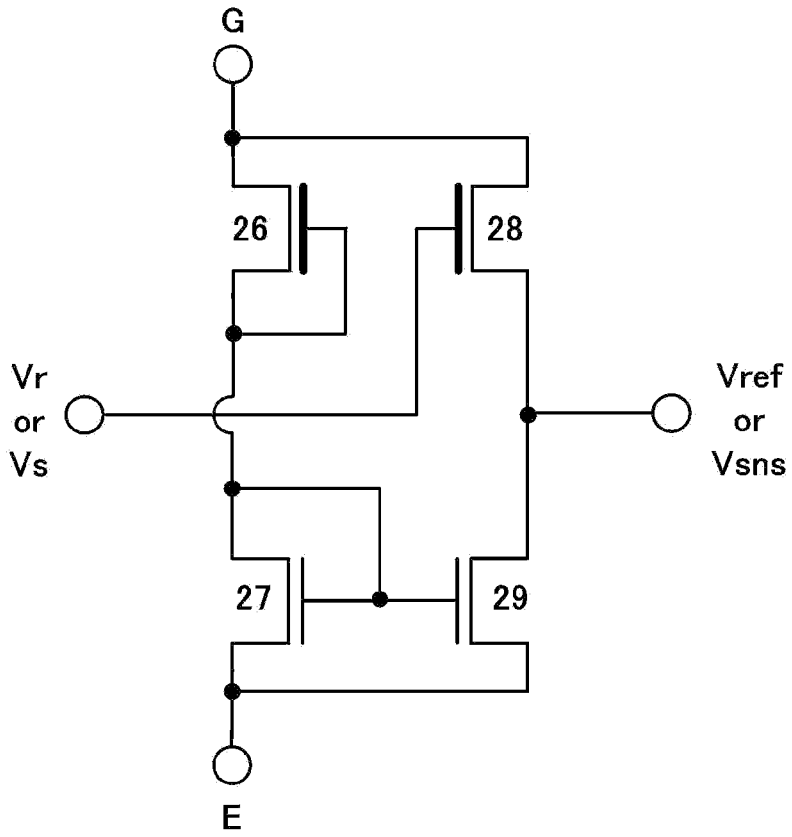
FIG. 4 shows an example of circuit construction of level shift circuits 14*a* and 14*b* in the semiconductor device according to embodiments of the present invention.
Figure 5:
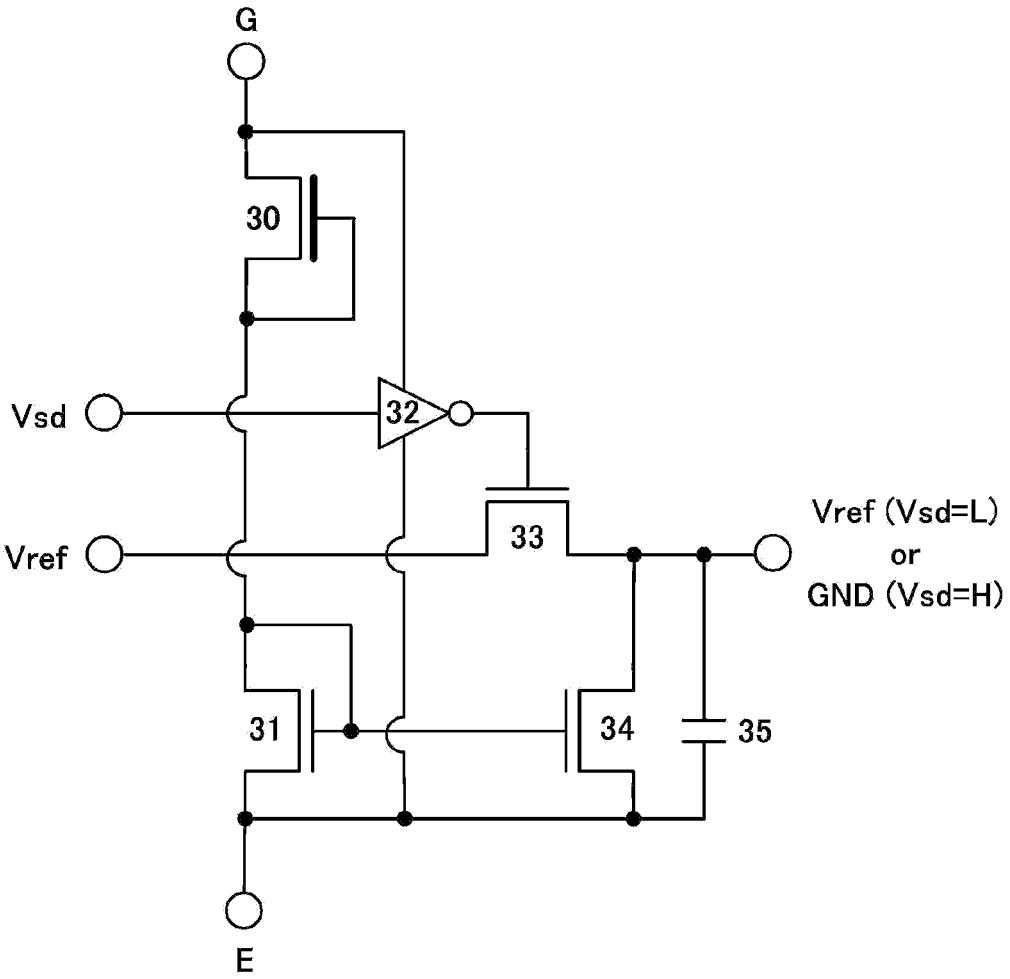
FIG. 5 shows an example of circuit construction of a self shut down circuit 16 in the semiconductor device according to embodiments of the present invention.
Figure 6:
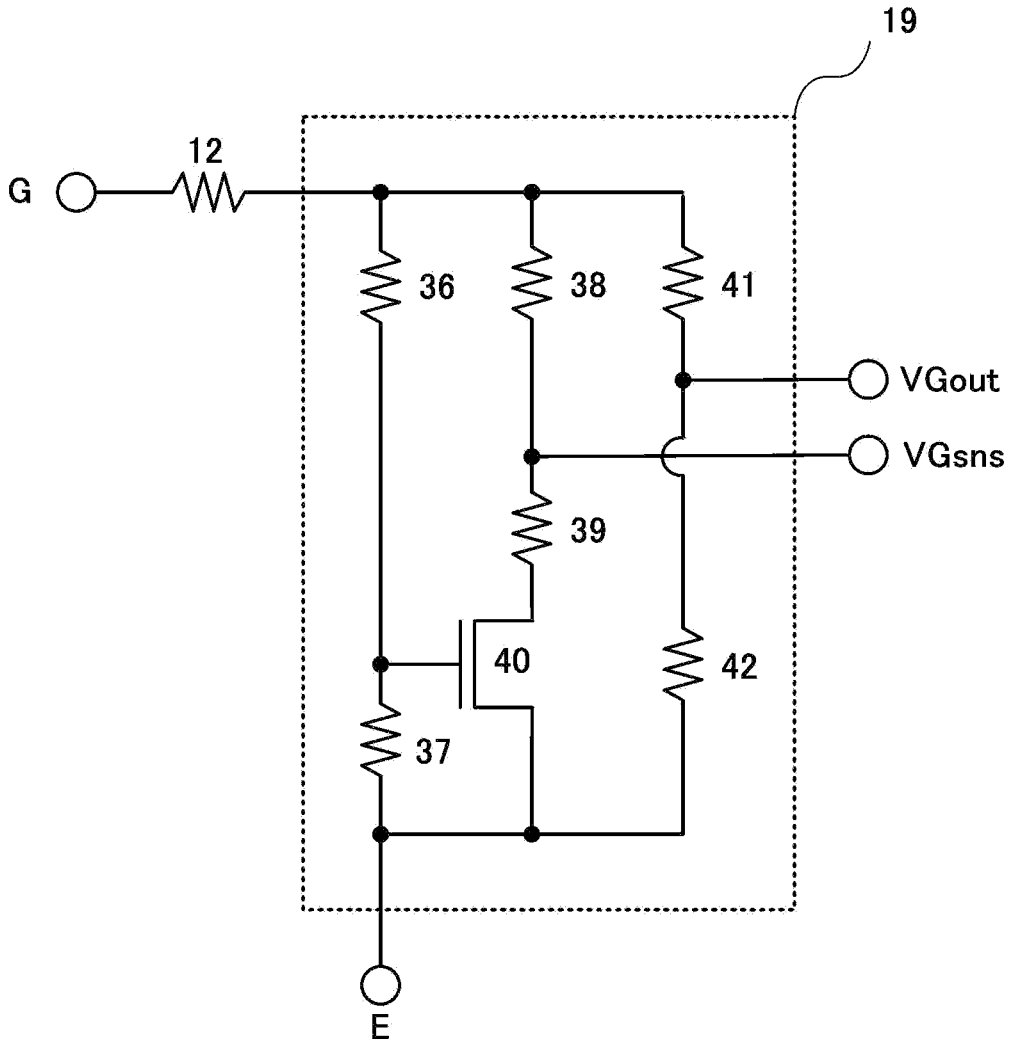
FIG. 6 shows an example of circuit construction of a gate voltage control circuit 19 in the semiconductor device according to embodiments of the present invention.

FIG. 1 shows an example of construction of an ignition semiconductor device providing a current control function and a self shut down function of an embodiment according to the present invention. The same symbols are given to the parts similar to those in the construction example of the conventional ignition semiconductor device shown in FIG. 2 and detailed description thereon is omitted.

The ignition semiconductor device shown in FIG. 1 comprises an ECU 1, an ignition IC 2, an ignition coil 7, a voltage source 10, and an ignition plug 11.

The ignition IC 2 comprises an output IGBT 4 (or "ON-OFF unit") for controlling ON-OFF of the primary current, a current in the primary winding, of the ignition coil 7 and a current control circuit 3 for controlling a magnitude of the primary current of the ignition coil 7. The ignition IC 2 has a C terminal connected to the ignition coil 7, an E terminal connected to the GND, and a G terminal connected to the ECU 1. While the ON-OFF unit is described herein as being an IGBT, in other embodiments, the switching unit can be a MOSFET or a bipolar transistor, as would be understood by one of skill in the art.

The current control circuit 3 is driven by the voltage between the G terminal and the E terminal. The current control circuit 3 comprises a sense IGBT 5, a sense resistance 6, a gate resistance 12, a reference voltage circuit 13, level shift circuits 14*a* and 14*b*, a self shut down signal generator 15, a self shut down circuit 16, an operational amplifier 17, a MOS 18, a gate voltage control circuit 19, a pulse generation circuit 20, and a switching circuit 21. This current control circuit 3 in FIG. 1 has a circuit construction having the pulse generation circuit 20 and the switching circuit 21 added to the conventional circuit construction of FIG. 2.

Figure 7:
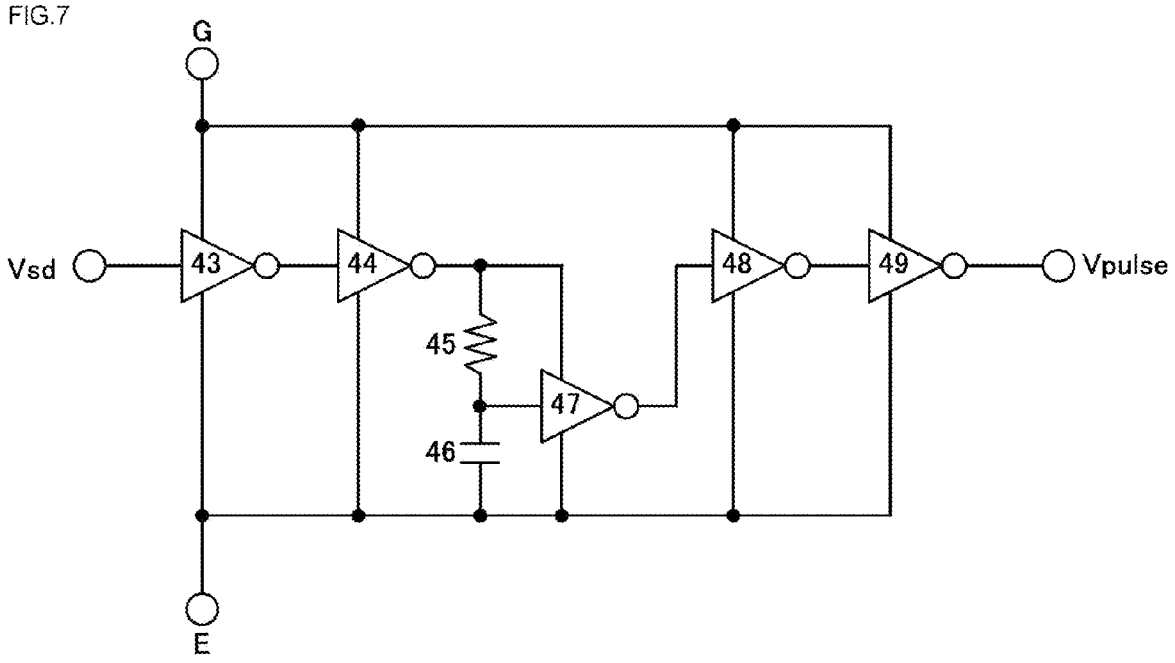
FIG. 7 shows an example of circuit construction of a pulse generation circuit 20 in the semiconductor device according to embodiments of the present invention.
Figure 8B:
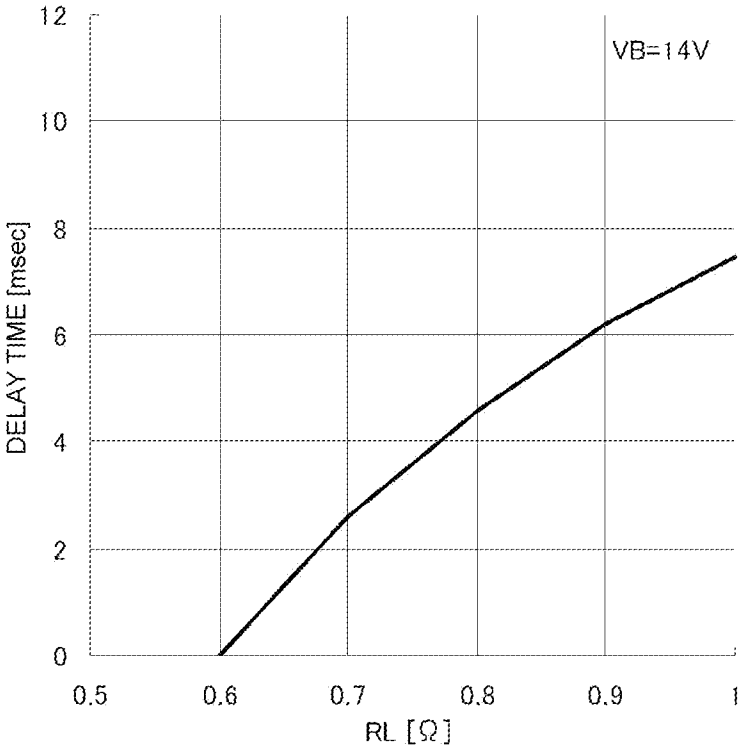
FIG. 8A and FIG. 8B show delay time characteristics in operation of the semiconductor device according to embodiments of the present invention.
Figure 8A:
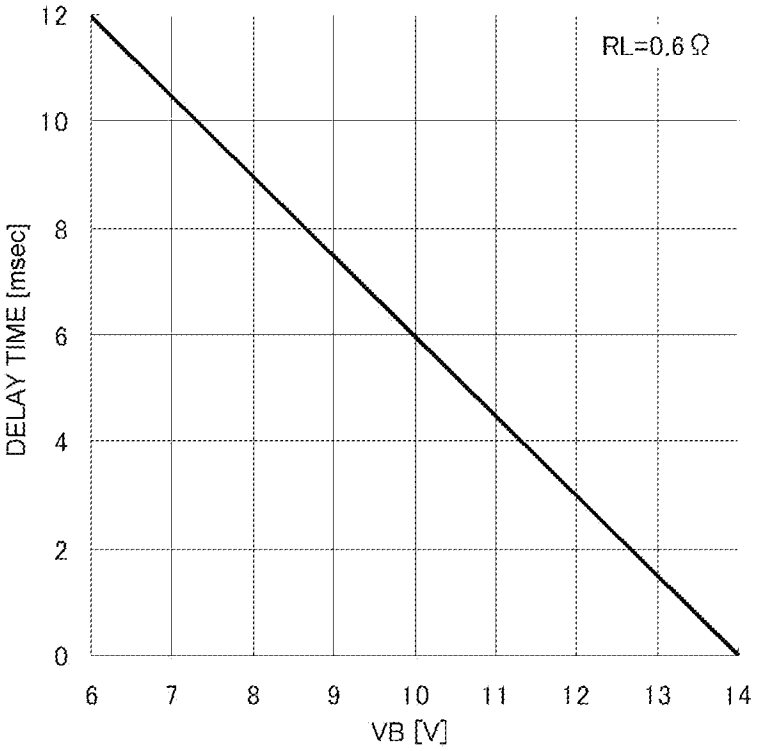

FIG. 7 shows an example of circuit construction of the pulse generation circuit 20. The pulse generation circuit 20 is driven by the voltage between the G terminal and the E terminal. The pulse generation circuit 20 comprises inverters 43, 44, 47, 48, 49, resistance 45, and a capacitor 46. An input self shut down signal Vsd is, through a buffer circuit composed of the inverters 43 and 44, delivered to an integration circuit composed of the resistance 45 and the capacitor 46 and to a driving voltage terminal of the inverter 47. A pulse signal in a short period of time is generated utilizing a delay time caused by the integration circuit relative to rise up of the driving voltage of the inverter 47, and delivered through a buffer circuit composed of the inverters 48 and 49 as a pulse signal Vp from the pulse generation circuit 20. The pulse width of the pulse signal Vp is set by a time constant of the integration circuit and a logical threshold value of the inverter 47.

The switching circuit 21 is connected to the reference voltage Vref at a terminal thereof and to the sense voltage Vsns at another terminal. The switching circuit 21 is composed of a semiconductor switching circuit having a semiconductor switching element such as a MOS and ON-OFF controlled by the pulse signal Vp delivered from the pulse generation circuit 20. When a self shut down signal Vsd is delivered, the pulse signal Vp is generated and delivered to the switching circuit 21, in which the semiconductor switching element becomes in the ON state during a short period of time, short-circuiting the sense voltage Vsns and the reference voltage Vref and making the voltages equal to each other.

A circuit construction is possible in which a voltage follower circuit is inserted between the operational amplifier 17 and one or both terminals of the switching circuit 21.

Now, operation of the ignition semiconductor device shown in FIG. 1 will be described with reference to FIG. 9(C), which shows operation waveforms in the case a self shut down operation is conducted while the current Ic does not reach the current limiting value Ilim like FIG. 9(B).

When an ON signal for example at 5 V is delivered from the ECU 1, the sense voltage Vsns increases but does not reach the reference voltage Vref and stays at a certain voltage lower than the reference voltage Vref from the time t4. When a self shut down signal Vds is delivered from the self shut down signal generator 15 at the time t5, self shut down operation starts. Simultaneously, a pulse signal Vp for example at 5 V is delivered for a short period of time for example 10 μsec from the pulse generation circuit 20 to the switching circuit 21 to short-circuit the + input terminal at the sense voltage Vsns and the − input terminal at the reference voltage Vref. As a result, the reference voltage Vref and the sense voltage Vsns become the same potential. Hence, the gate voltage VGout of the output IGBT 4 decreases. When the pulse signal Vp returns to zero volts, the switching circuit 21 is opened and the reference voltage Vref is decreased by the self shut down circuit 16 while maintaining the equality Vref=Vsns to decrease the current Ic. When the VGout reaches the threshold voltage Vth of the IGBT 4, the current Ic is completely shut down.

Figures 9A, 9B, 9C:
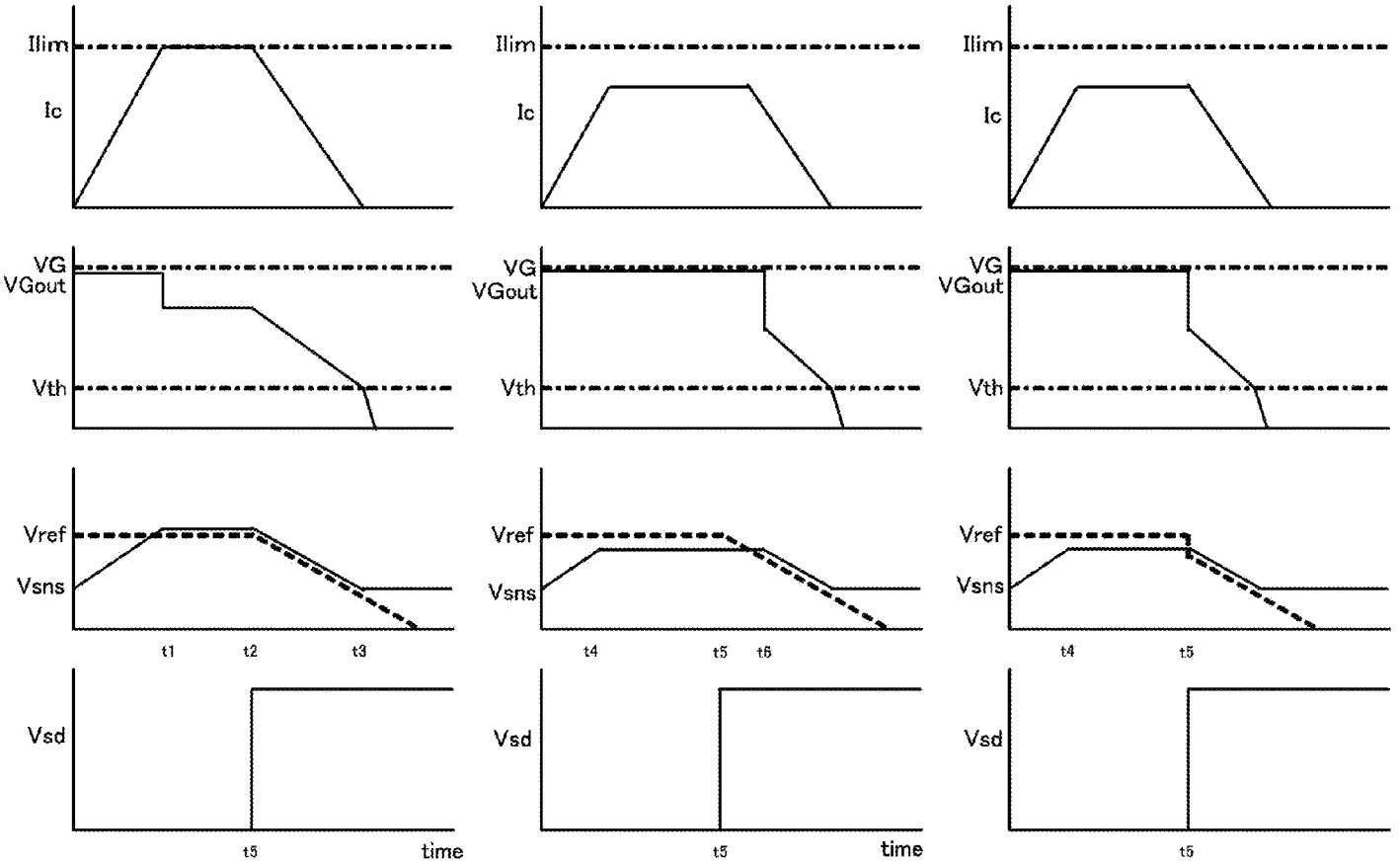
FIGS. 9A, 9B, and 9C show operation waveforms in a conventional device and in embodiments of the invention.

The operation of embodiments of the invented device shown in FIG. 9C is similar to that of the conventional device shown in FIG. 9B until the self shut down signal Vsd is delivered and the self shut down operation starts at t5. After the start of self shut down operation, however, the conventional device causes a delay time t6−t5 as shown in FIG. 9B until the equality Vref=Vsns is established. In contrast, the device of the invention achieves the equality Vref=Vsns at the starting moment of the self shut down operation without any delay time.

As described thus far, a semiconductor device for ignition providing a current control function and a self shut down function according to the invention comprises a pulse generation circuit 20 and a switching circuit 21 in a current control circuit 3, and short-circuits the reference voltage Vref and the sense voltage Vsns for a short period of time at the starting time of self shut down operation. Therefore, self shut down operation is carried out without a delay time and independently of the driving voltage and the load resistance value. In addition, the device of the invention comprises a gate voltage control circuit 19 that sets a voltage difference, an offset, between the gate voltage for the output IGBT 4 and the one for the sense IGBT 5 based on the difference between the reference voltage Vref and the sense voltage Vsns. The control by this circuit construction suppresses oscillation of the current Ic in the self shut down operation and thus avoids erroneous ignition of an ignition plug.

The present invention should not be limited to the embodiments describe thus far but can be modified and improved without departing from the spirit and scope of the invention.

Examples of specific embodiments are illustrated in the accompanying drawings. While the invention is described in conjunction with these specific embodiments, it will be understood that it is not intended to limit the invention to the described embodiments. On the contrary, it is intended to cover alternatives, modifications, and equivalents as may be included within the spirit and scope of the invention as defined by the appended claims. In the above description, specific details are set forth in order to provide a thorough understanding of embodiments of the invention. Embodiments of the invention may be practiced without some or all of these specific details. Further, portions of different embodiments and/or drawings can be combined, as would be understood by one of skill in the art.

This application is based on, and claims priority to, Japanese Patent Application No. 2011-034463, filed on Feb. 21, 2011. The disclosure of the priority application, in its entirety, including the drawings, claims, and the specification thereof, is incorporated herein by reference.

What is claimed is:

1. A semiconductor device providing a current control function and a self shut down function, the semiconductor device comprising:

an insulated gate bipolar transistor for controlling ON-OFF of a primary current in a primary winding of an ignition coil responding to an ignition signal and a current control circuit for controlling a magnitude of the primary current;

the current control circuit comprising:

a self shut down circuit for shutting down the primary current on detection of one of abnormal states including an overcurrent state in which the primary current exceeds a predetermined rated current;

wherein the current control circuit sets the rated current to be equal to the primary current on detection of the abnormal states by the self shut down circuit.

2. The semiconductor device according to claim 1, wherein the self shut down circuit generates a reference voltage at one terminal of a capacitor provided in the self shut down circuit, the reference voltage being obtained by converting the rated current to the reference voltage, and the semiconductor device detects a sense voltage that is obtained by converting the primary current to the sense voltage and controls the primary current so that the sense voltage equals the reference voltage; and the voltage at the one terminal of the capacitor is equalized to the sense voltage on detection of the abnormal state by the self shut down circuit.

3. The semiconductor device according to claim 2, wherein after equalizing the sense voltage and the voltage at the one terminal of the capacitor, the capacitor is separated from a terminal that is at the sense voltage and discharged by a bias circuit of the self shut down circuit.

4. A semiconductor device providing a current control function and a self shut down function comprising an insulated gate bipolar transistor for controlling ON-OFF of a primary current in a primary winding of an ignition coil responding to an ignition signal and a current control circuit for controlling a magnitude of the primary current, the current control circuit comprising:

a sense voltage detection circuit for detecting a sense voltage that is a voltage obtained by converting the primary current;

a reference voltage circuit for generating a reference voltage that is a voltage obtained by converting a predetermined rated current;

a gate voltage control circuit for detecting a voltage difference between the sense voltage and the reference voltage and for controlling a gate voltage of the insulated gate bipolar transistor so as to equalize the primary current to the rated current;

a self shut down circuit for shutting down the primary current on detection, by the self shut down circuit, of one of abnormal states, including an overcurrent state, in which the primary current exceeds the rated current;

a pulse generation circuit for generating a pulse signal for a short period of time on detection of the one of abnormal states by the self shut down circuit; and a switching circuit for executing ON-OFF operation thereof controlled by the pulse signal; wherein the switching circuit is made in a conductive state for a short period of time by the pulse signal on occurrence of the one of abnormal states to set the reference voltage to become equal to the sense voltage.

5. The semiconductor device according to claim 4, wherein the switching circuit comprises a MOSFET.

6. The semiconductor device according to claim 4, wherein the pulse generation circuit comprises an integration circuit and an inverter that receive a self shut down signal informing detection of the one of abnormal states by the self shut down circuit at an terminal of the integration circuit and at a driving voltage terminal of the inverter, and an output from the integration circuit is delivered to the inverter to generate a pulse signal for a short period of time.

7. A semiconductor device providing a current control function and a self shut down function, the semiconductor device comprising:

an ON-OFF unit for controlling ON-OFF of a primary current in a primary winding of an ignition coil responding to an ignition signal and a current control circuit for controlling a magnitude of the primary current;

the current control circuit comprising:

a self shut down circuit for shutting down the primary current on detection of one of abnormal states including an overcurrent state in which the primary current exceeds a predetermined rated current;

wherein the current control circuit sets the rated current to be equal to the primary current on detection of the abnormal states by the self shut down circuit.

8. The semiconductor device according to claim 7, wherein the ON-OFF unit is a MOSFET.

9. The semiconductor device according to claim 7, wherein the ON-OFF unit is a bipolar transistor.

* * * * *